US012454336B2

(12) United States Patent
Vouillamoz et al.

(10) Patent No.: US 12,454,336 B2
(45) Date of Patent: Oct. 28, 2025

(54) MODULAR FLOATING STRUCTURE AND METHOD OF CONSTRUCTION

(71) Applicant: LEGACY FOUNDRY AG, Zürich (CH)

(72) Inventors: Lucien Vouillamoz, Feusisberg (CH); Francisco Daniel Rincon Hanna, Zollikerberg (CH); Alain Jaccard, Ste-Croix (CH); Pascal Boschi, Les Geneveys-sur-Coffrane (CH)

(73) Assignee: Legacy Foundry AG, St. Blaise (CH)

( * ) Notice: Subject to any disclaimer, the term of this patent is extended or adjusted under 35 U.S.C. 154(b) by 670 days.

(21) Appl. No.: 17/263,167

(22) PCT Filed: Jul. 26, 2019

(86) PCT No.: PCT/IB2019/056405

§ 371 (c)(1),
(2) Date: Jan. 26, 2021

(87) PCT Pub. No.: WO2020/021507

PCT Pub. Date: Jan. 30, 2020

(65) Prior Publication Data

US 2021/0188405 A1 Jun. 24, 2021

Related U.S. Application Data

(60) Provisional application No. 62/703,521, filed on Jul. 26, 2018, provisional application No. 62/856,826, filed on Jun. 4, 2019.

(51) Int. Cl.
*B63B 35/44* (2006.01)
*B63B 13/00* (2006.01)
(Continued)

(52) U.S. Cl.
CPC ..... *B63B 35/44* (2013.01); *B63B 13/00* (2013.01); *B63B 35/32* (2013.01); *B63B 73/40* (2020.01)

(58) Field of Classification Search
CPC ..... B63B 35/44; B63B 13/00; B63B 73/40; B63B 35/32
See application file for complete search history.

(56) References Cited

U.S. PATENT DOCUMENTS

1 A * 7/1836 Ruggles ..... B61C 11/04 295/4
788,254 A * 4/1905 Ferrandini ..... A41B 3/02 267/71

(Continued)

FOREIGN PATENT DOCUMENTS

EP 2405072 A2 * 1/2012 ..... E04D 13/0305
ES 2405704 B 3/2014

(Continued)

OTHER PUBLICATIONS

International Search Report, International patent application No. PCT/IB2019/056405, Jan. 10, 2020.

*Primary Examiner* — S. Joseph Morano
*Assistant Examiner* — Jovon E Hayes
(74) *Attorney, Agent, or Firm* — DA VINCI PARTNERS LLC; John Moetteli

(57) ABSTRACT

A floating territory is made of at least two floatable building components having the shape of a prism with a regular polygon base, such as a triangle, a square, a pentagon, a hexagon, etc. combined with sliding dovetails and dovetail grooves for sliding attachment to neighboring construction elements. The attachments allow the floatable building components to slide vertically relative to each other, thereby permitting the floating territory to follow the upward and (Continued)

downward movement of the waves. A method of converting floating ocean waste into structures, in particular, floating territories is also provided.

21 Claims, 16 Drawing Sheets

(51) Int. Cl.
*B63B 35/32* (2006.01)
*B63B 73/40* (2020.01)

(56) References Cited

U.S. PATENT DOCUMENTS 3,788,254 A * 1/1974 Sheil ..... B63B 35/4413 114/266
3,974,789 A * 8/1976 de Groot ..... B63B 21/50 441/28
8,038,067 B2 * 10/2011 Albers ..... G07F 7/0806 235/487
2008/0038067 A1 * 2/2008 Sharapov ..... B63B 35/44 405/224
2012/0312219 A1 * 12/2012 Broad ..... B63B 35/38 114/264
2016/0000083 A1 * 1/2016 Saiga ..... A01N 47/18 514/340
2016/0083052 A1 * 3/2016 Valtanen ..... B63B 35/44 114/256
2017/0274966 A1 9/2017 Boonlikitcheva

FOREIGN PATENT DOCUMENTS

JP 49015841 Y1 * 4/1974 ..... B63B 35/38
JP S49015841 Y 4/1974
JP 55042653 U * 3/1980 ..... B63B 35/38
JP S55042653 U 3/1980
JP H0626029 A * 2/1994 ..... B63B 35/38
JP 2017530051 A * 10/2017 ..... B63B 35/38
KR 20110080999 A 7/2011
KR 20110080999 * 8/2011 ..... B63B 35/44

* cited by examiner

MODULAR FLOATING STRUCTURE AND METHOD OF CONSTRUCTION

CROSS REFERENCE TO RELATED APPLICATIONS

This application is the National Stage of International Application No. PCT/IB2019/056405, filed Jul. 26, 2019, which claims benefit under 35 USC § 119 (a), to U.S. provisional patent application Ser. No. 62/703,521 filed Jul. 26, 2018 and to U.S. provisional patent application Ser. No. 62/856,826 filed Jun. 4, 2019.

COPYRIGHT & LEGAL NOTICE

A portion of the disclosure of this patent document contains material which is subject to copyright protection. The Applicant has no objection to the facsimile reproduction by anyone of the patent document or the patent disclosure as it appears in the Patent and Trademark Office patent file or records, but otherwise reserves all copyright rights whatsoever. Further, no references to third party patents or articles made herein is to be construed as an admission that the present invention is not entitled to antedate such material by virtue of prior invention.

BACKGROUND OF THE INVENTION

This invention relates to the creation of modular floating structures, for example made from waste material, such as plastic waste, which is unfortunately present in and floating on large rivers and oceans as well as on the land. Several projects exist with the aim to recuperate waste from the oceans and bring it back in one form or another to the land; waste found on the land may also be collected and re-used. In addition, it is widely recognized that the current Earth's climate change is generating a general rise in sea level, ultimately leading to the disappearance of vast surfaces of habitable land. Recovery of some of this land is desirable, particularly as the Earth's population continues to increase.

It is known to provide a substantially rigid floating platform to create a territory on water. When there are interlocking shapes, they are typically added in more than one direction, so that there is little possible play between floating components. Attachment elements are designed with such a shape that they lock the floating components to each other.

It is also known to combine main floating elements with other elements. In several cases there are "main floating elements", "secondary floating elements", and as mentioned above, there are fixation/attachment elements.

What is needed is an effective means of putting this waste to constructive use for the replacement or for the creation of additional territory suitable for human habitation or activities in a flexible way, that allows for movement between building elements.

Still further, what is needed is a floating territory which follows the movement of the waves, being free to move vertically thanks to a dovetail guides which has limited play in the horizontal plane.

What is needed is a floating territory which is made of elements which have gliding features between floatable building components. Gliding features might include a coating or bumps on the floatable building components as later described.

SUMMARY OF THE INVENTION

This invention combines a solution for re-using waste and a solution for creating new habitable ground in the form of floating islands or peninsulas. A system and method/apparatus is provided to this end which includes a set of floatable building components (hereafter FBC) made from material of relatively low mechanical resistance, such as for example recycled plastic waste, or out of any other suitable material.

A method of creating these FBCs of the invention includes several steps. In a first step, suitable waste—deposits, which may be floating, are located. In a second step, the nature and distribution of the waste deposits are analyzed. In a third step, based on the results of the analysis, a recovery and recycling protocol applying dedicated equipment suitable to a construction objective is developed. In a fourth step, the waste is harvested using waste gathering means selected according to the protocol. In a fifth step, the waste is sorted and gathered into types of waste suitable for selected processes applied by the dedicated equipment. In a sixth step, the selected waste is processed according to the selected processes to create building elements for use in the construction objective. In a seventh step, the FBCs are optionally filed with water or other materials in order to adjust their floating height or buoyancy, and by way of consequence, the global shape of the island.

An object of the invention is to assemble and/or interconnect the FBCs among each other in order to create a "semi-rigid" assembly to constitute a floating island or peninsula. "Semi-rigid" as used herein refers to elements which are rigid but which are connected together so as to allow relative movement in at least one plane. A "semi-rigid" assembly that allows for an optionally limited relative freedom of movement between FBCs may also be called an articulated assembly.

Another object of the invention is to provide appropriate attachment means to control the relative movements of the FBC. Still another object of the invention is to design the FBC so that they can be produced and assembled at the site of waste collection or at the site where they are to be used to create a floating territory.

Another object of the invention is to provide a structure that makes it possible to build a territory with floatable building components which are all identical (See FIG. 6A). Still another object of the invention is to provide a structure that makes it possible to build a territory without any additional attachment between the floatable building components (features 1116/1210)

As a result, the invention provides a floating territory able to follow the upward and downward movement of the waves and that can therefore be installed both close to the shores as well as on the high seas. Such floating territory may also be used as a link between existing natural and/or artificial territories, and take the form of a walkable path, or even a track suitable for vehicles.

BRIEF DESCRIPTION OF THE DRAWINGS

The attached drawings represent, by way of example, different embodiments of the invention.

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT

The following description is not intended to limit the scope of the invention in any way as it is exemplary in nature, serving to describe the best mode of the invention known to the inventors as of the filing date hereof. Consequently, changes may be made in the arrangement and/or function of any of the elements described in the exemplary embodiments disclosed herein without departing from the spirit and scope of the invention.

Figure 1:
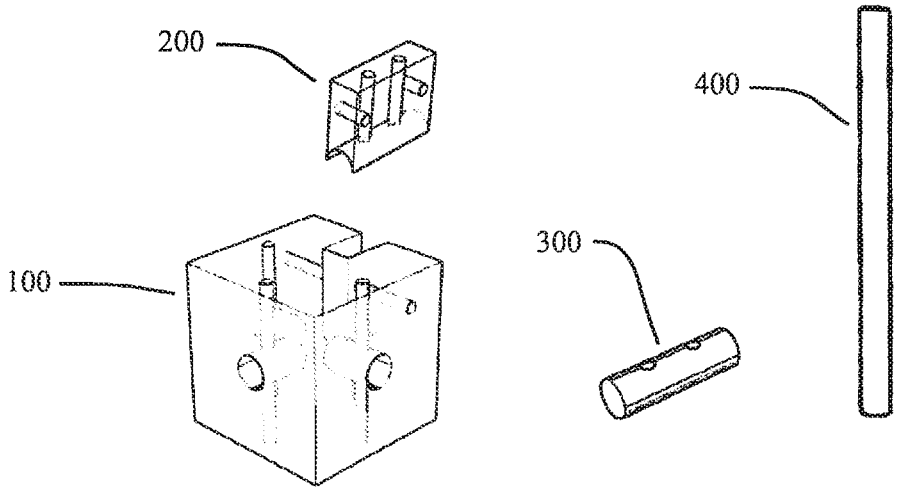
FIG. 1 is a perspective view of a set of floatable building components of the invention.
Figure 2:
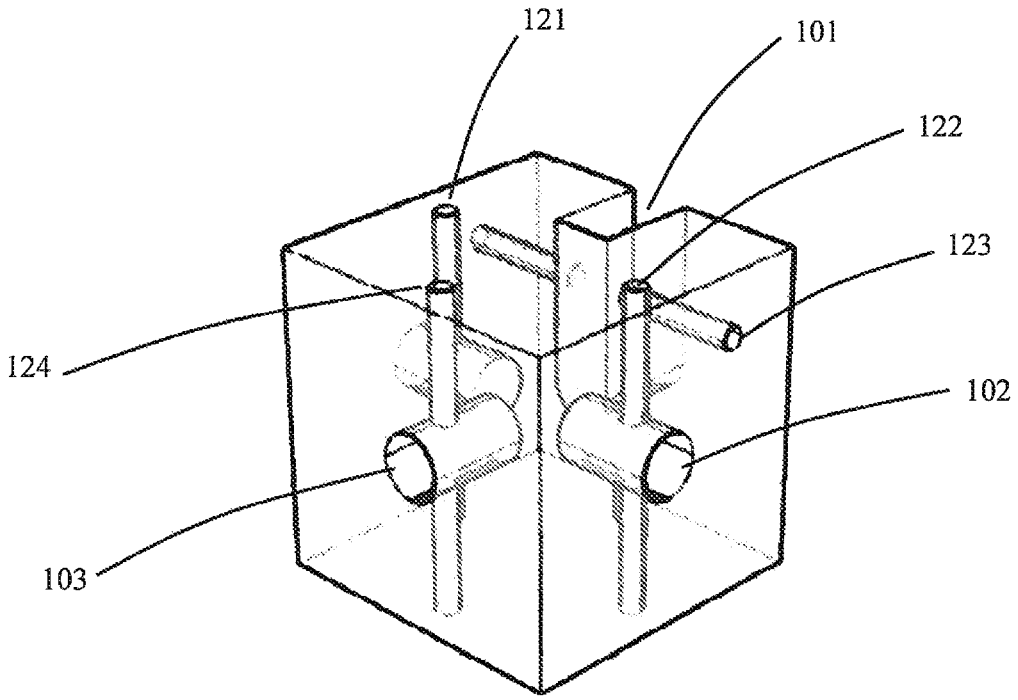
FIG. 2 is a perspective view of a main construction element of the system of the invention.

Referring now to FIG. 1, the system according to this invention consists of a set of floatable building components (hereafter FBC) made from recycled plastic waste or any other suitable material.

Figure 3:
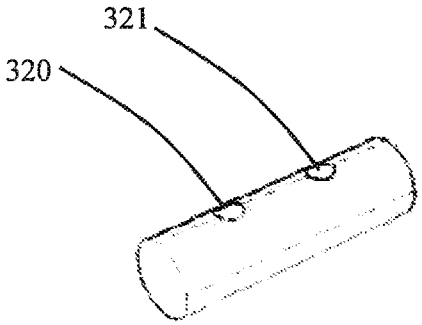
FIG. 3 is a perspective view of a junction element of the system of the invention.
Figure 4A:
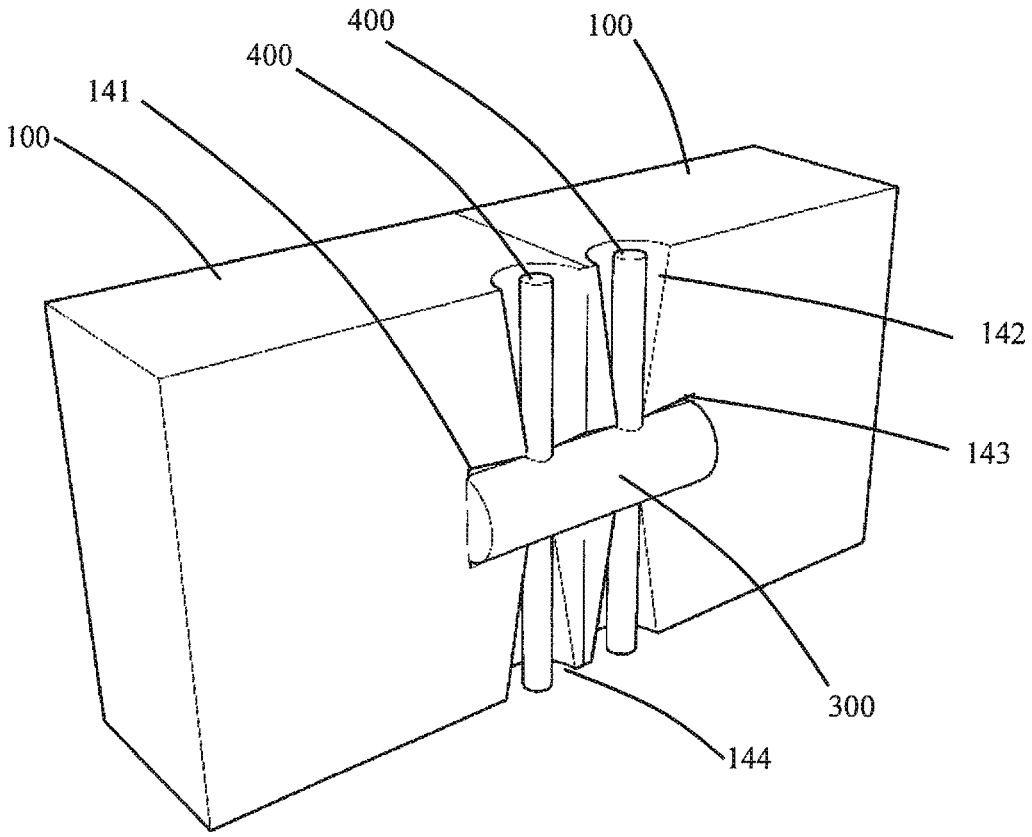
FIGS. 4A-4B are perspective cut views of means to provide an articulated assembly of the system of the invention.
Figure 4B:
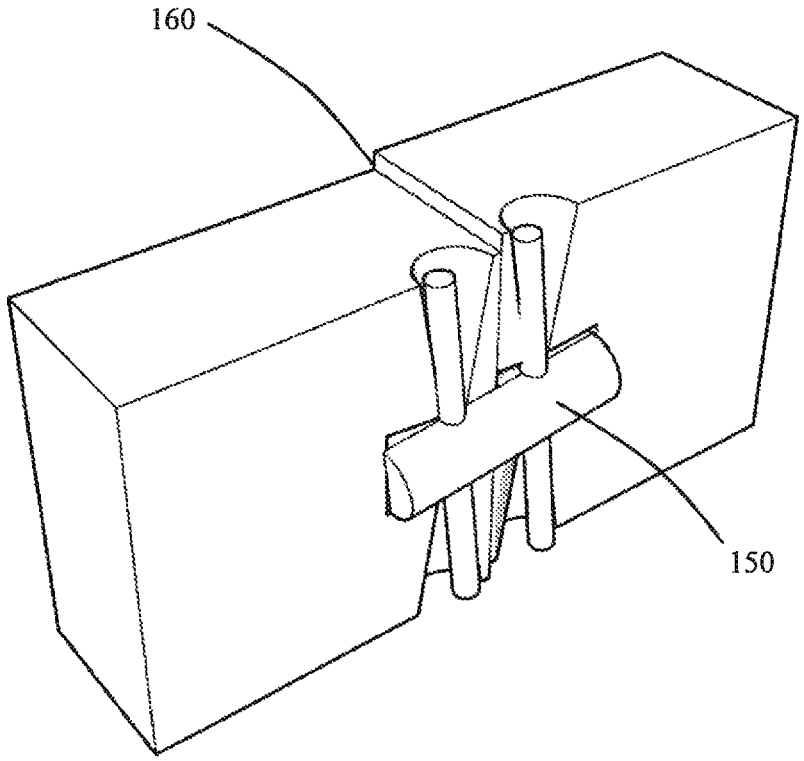
Figure 5A:
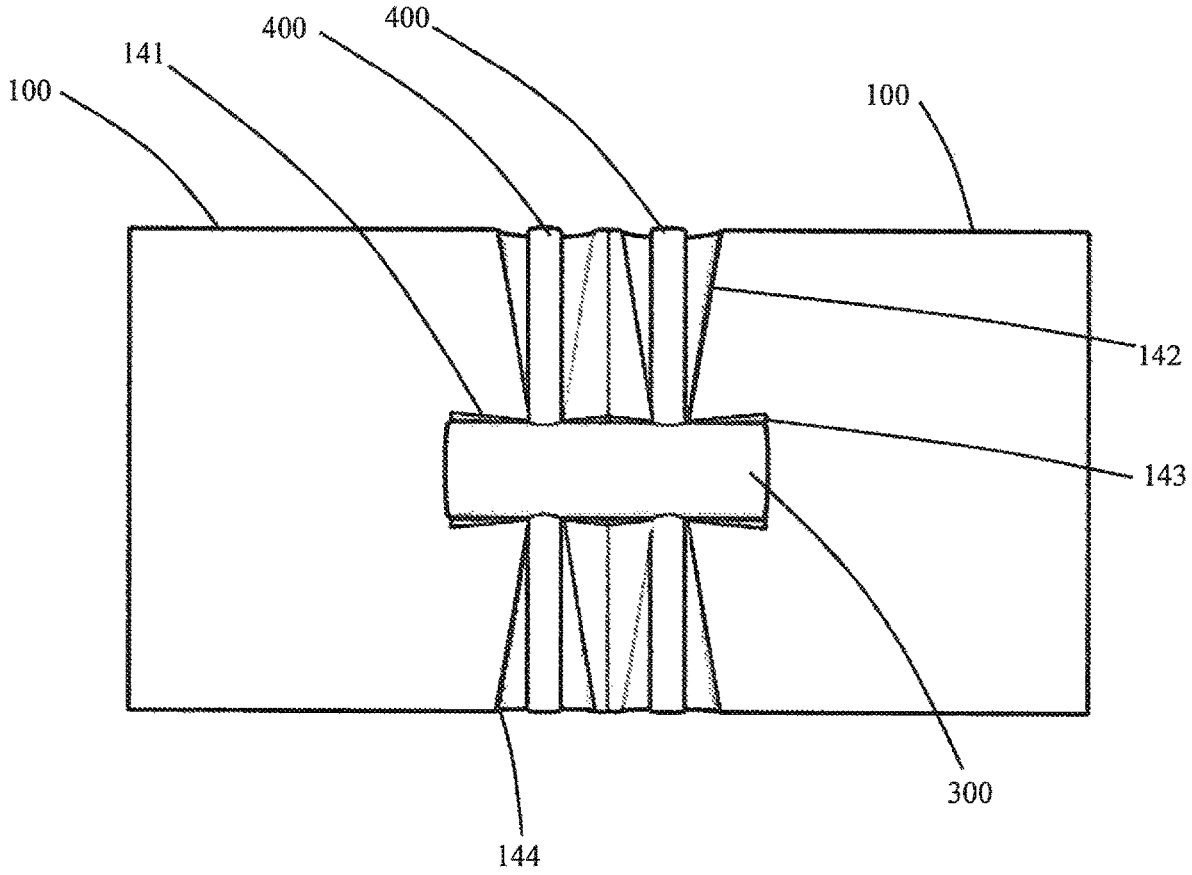
FIGS. 5A-5B are side cut views of means to provide an articulated assembly of the system of the invention.
Figure 5B:
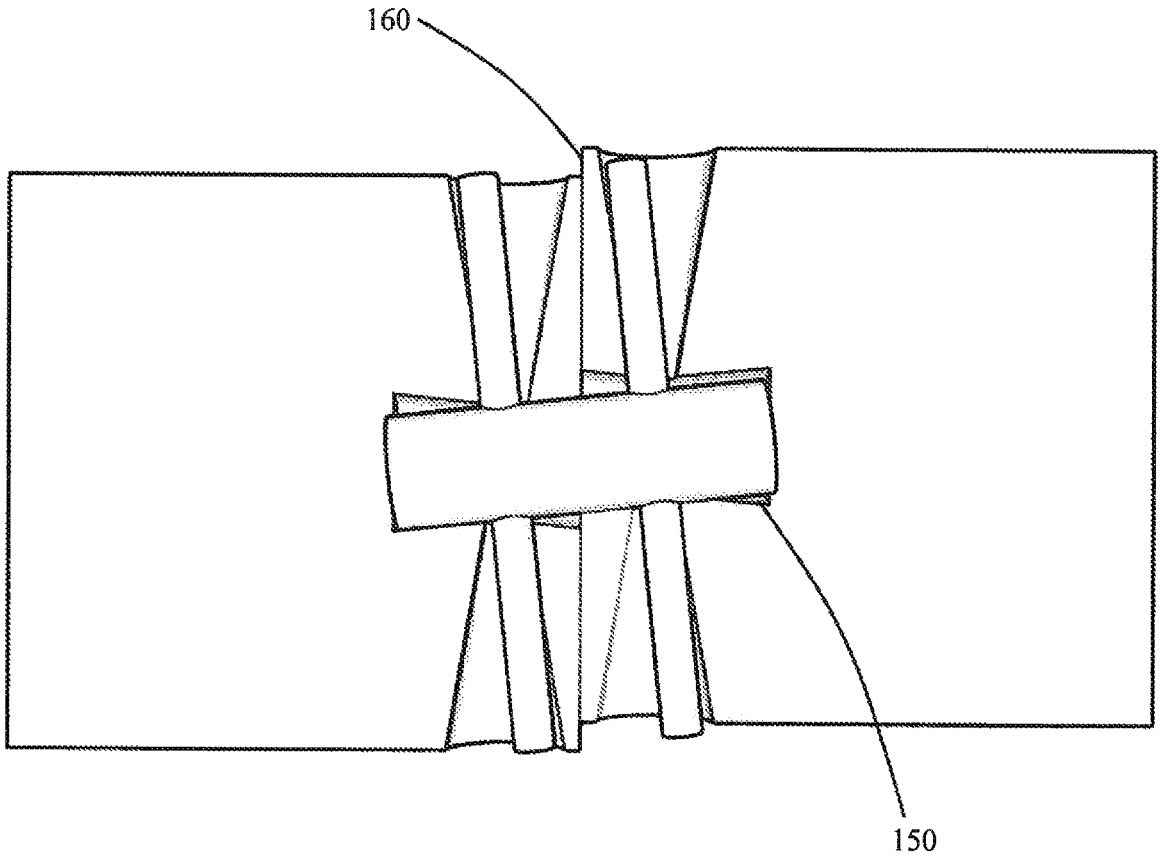

The FBCs have an appropriate shape so that they can be assembled together to form at least a part of a floating island or of a peninsula, or of a floating path/road. FBCs may have different shapes as required for the fulfilling of dedicated functions. By way of example, FBCs may be formed as main construction elements or junction elements. The main construction elements preferably have an essentially parallelepiped shape. Junction elements preferably have an essentially cylindric shape and/or an elongated shape. The shapes of the FBC may include "poka-yoke" features so as to ensure fast and easy assembling. A «poka-yoke» is any mechanism in a lean manufacturing process that helps an equipment operator avoid (yokeru) mistakes (poka). Its purpose is to eliminate product defects by preventing, correcting, or drawing attention to human errors as they occur. The shape of the construction elements and junction elements may also present guiding and sliding features to allow for relative displacement of the construction elements in any direction. FCBs may be formed as other elements of course. Other elements may have more specific shapes to fulfil other dedicated functions such as sea access ramp or stairs, waves energy absorber, plant culture containers, or the like. The design of FBCs may also include attachment handles or interlocking interfaces as appropriate for assembling into an articulated floating structure. To allow for building the articulated structure while floating, a set of such FBCs may include the following elements:

a. Main construction element 100, 1100 (FIG. 1, FIG. 2, FIGS. 6A-C)
b. Secondary construction element 200, 1200 (FIG. 1, FIGS. 6A-6C)
c. Junction element 300 (FIG. 1, FIG. 3)
d. Locking element 400, 1210 (FIG. 1, FIGS. 6A-6C)

The main construction element 100 has an essentially parallelepiped shape and includes recesses 101, 102, 103, both adapted to fit to the shapes of a secondary construction element 200 and adapted to fit to the shape of junction elements 300, and thru-holes 121, 122, 123, 124 adapted to fit to the shape of a locking element 400. Junction elements 300 may include thru-holes 320, 321 corresponding to the shape of the locking element 400. The localisation of the recesses 101, 102, 103 and locking holes 121, 122, 123, 124 is made to allow the progressive assembling of main construction elements 100 in rows and columns while floating on water without the need for the assembly operators to dive under the surface of the water in order to assemble.

Referring now to FIGS. 4A-4B and FIGS. 5A-5B, the recesses 101, 102, 103 and locking holes 121, 122, 123, 124, 320, 321 may have an essentially parallelepiped shape or cylindrical shape or any combination thereof, and may include some conicity angles 141, 142, 143, 144 to provide predefined rigid contact points and angles 150 of limited rotational freedom and/or limited displacement 160 between the assembled elements. When the FBC are partially or fully immersed, the water contained in the volumes generated by the conical angles 141, 142, 143, 144 is forced to move and participates in the absorption of the energy of movement. The main construction elements 100, secondary construction elements 200, junction elements 300 and locking elements 400 may be built as hollow watertight containers, so that they can be filled after assembly to an appropriate level with sea water or with waste or with any other material so that their density can be adjusted, resulting in a floating height adapted to their function within the articulated assembly constituting the floating island or peninsula.

Figure 6A:
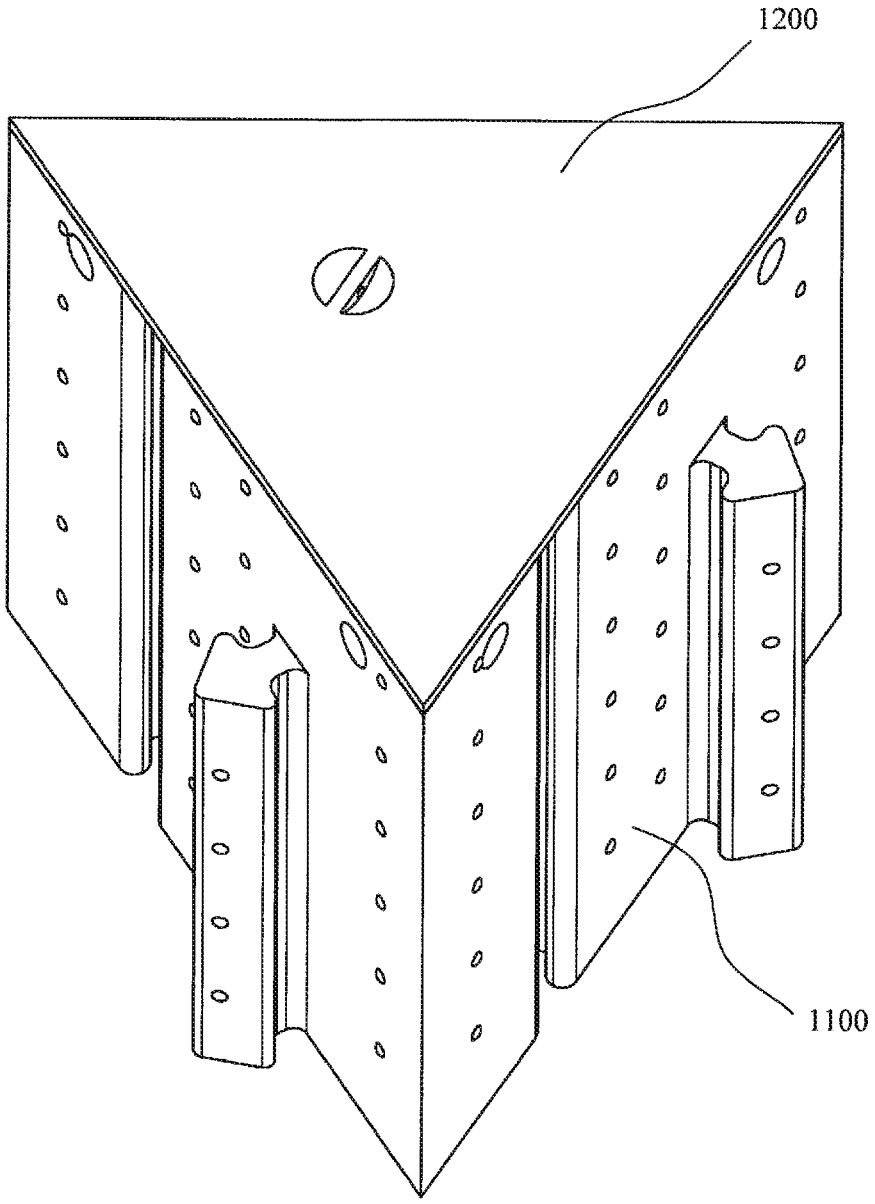
FIGS. 6A-6B are perspective views of a set of floatable building components of the invention.
Figure 6B:
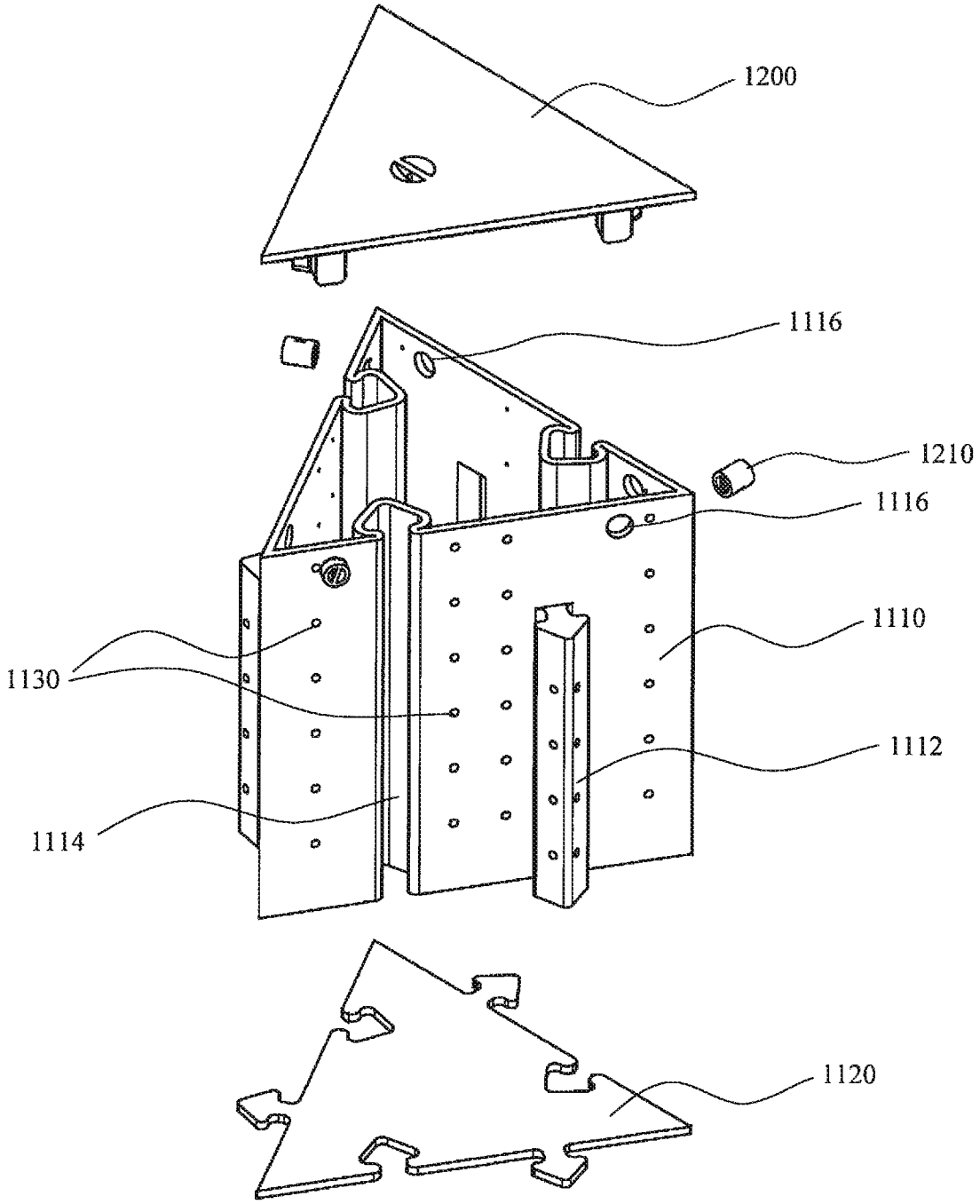
Figure 6C:
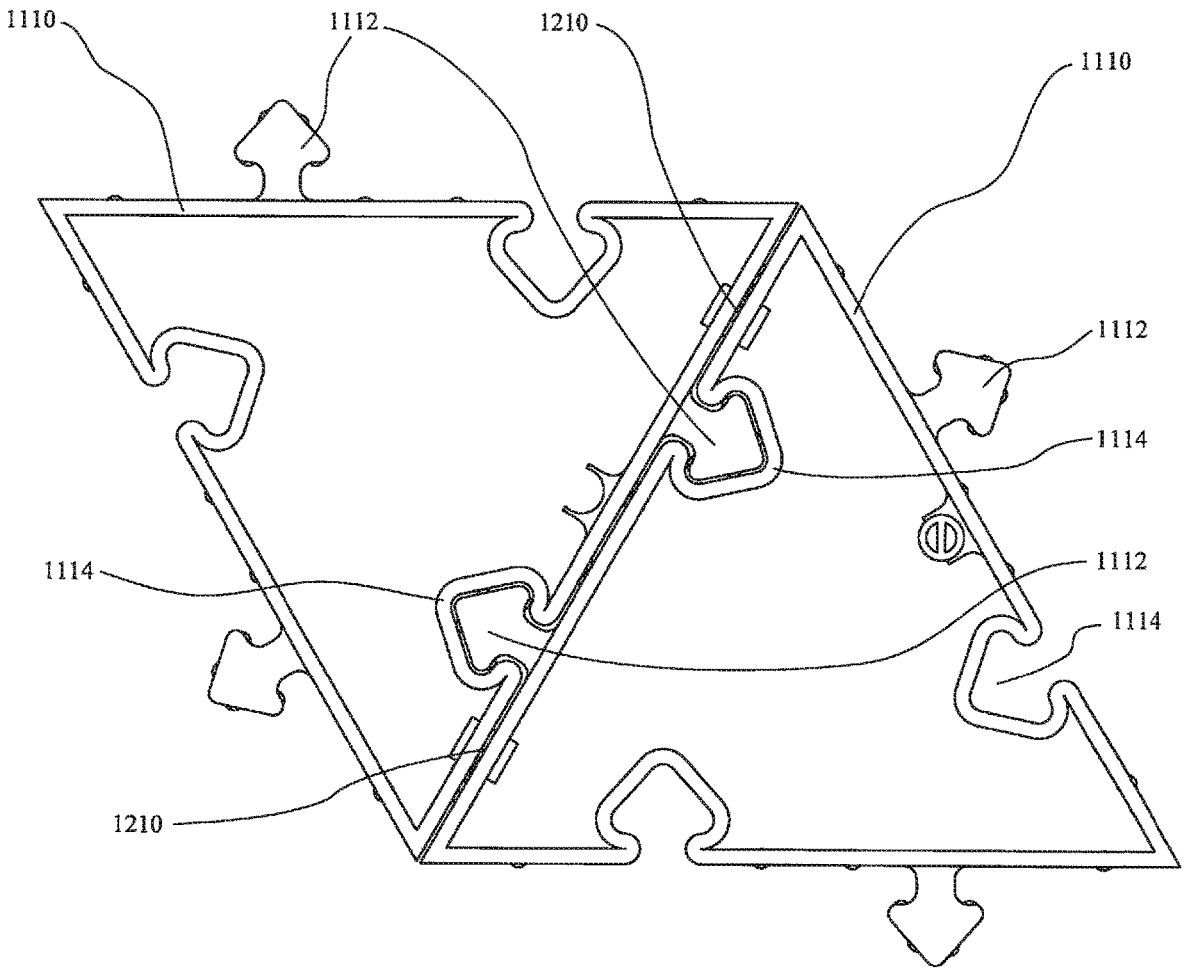
FIG. 6C is a top view of two building components assembled together.

Referring now to FIGS. 6A-6C, the system according to the present invention may be advantageously built using a combination of hollow construction elements 1100, covers 1200 and lockers 1210. The construction element 1100 may essentially have the shape of a prism with a regular polygon base, such as a triangle, a square, a pentagon, a hexagon, etc. combined with dovetails 1112 and dovetail grooves 1114 for attachment to neighboring construction elements. The bottom 1120 of the construction element 1100 may optionally be produced as a separate part and assembled unto the wall 1110 to form a watertight hollow container. The bottom 1120 of the construction element 100 may optionally contain a valve or a tightly closable lid so as to allow emptying or filling of the construction element. Attachment of the bottom 1120 to the wall 1110 may use gluing, welding, over molding, or any other water-tight attachment technique known in the industry. In one embodiment, locking elements such as set screws may also be used. The bottom 1120 and the wall 1110 of the construction element 1100 may also be produced directly in one piece, using processes like injection molding, blow molding, thermoforming, extrusion, and any other process known in the art, At least one dovetail 1112 and dovetail groove 1114 is present on each side of the wall 1110, so as to provide an attachment means to a neighboring construction element while keeping a freedom to move and providing a guiding vertically. The wall 1110 may include holes 1116 near the top surface of the construction element 1100 so as to be located above the water level and allow a substantially rigid attachment when inserting the lockers 1210 in the holes 1116. The dovetails 1112 may have a length shorter than the height of the construction element 1100, so that the addition of a cover 1200 on top of the construction element 1100 closing the end of the dovetail groove 1114 limits the freedom to move vertically, relative to a neighboring construction element 1100. The cover 1200 may have several functions, such as closing the construction element 1100 in a watertight manner, and/or limiting the vertical freedom of movement of a given construction elements relative to its neighbors, and/or providing a substantially seamless surface together with the neighbouring construction elements. It has to be understood that the "dovetail and dovetail groove" wording used here describes by way of example any other combination of shapes that allows interlocking two construction elements while maintaining a freedom to move or slide and providing a guiding in one essentially linear direction.

The walls 1110 of the construction element 1100 may have bumps 1130 on its surface to avoid any sticking effect when immersed in the water, so that the vertical guiding effect happens with minimal friction. Surface treatment against friction, and/or antifouling surface treatment may also be applied on the surface of the construction element 1100. In fact, ocean or lake water can act as a lubricant to minimize wear between the elements as they rub against each other during relative movement. The bottom 1120 of the construction element 1100 may also present additional features protruding under the water, such as fins or spoilers, to impart a preferred direction of movement for the floating territory in the surrounding water, particularly water that is flowing, or to manage the lateral forces produced by the marine currents. Motors driving propellers and control surfaces such as rudders may be attached under one or more of the construction elements 1100 of a floating territory to allow for displacement of the entire territory.

Figure 7:
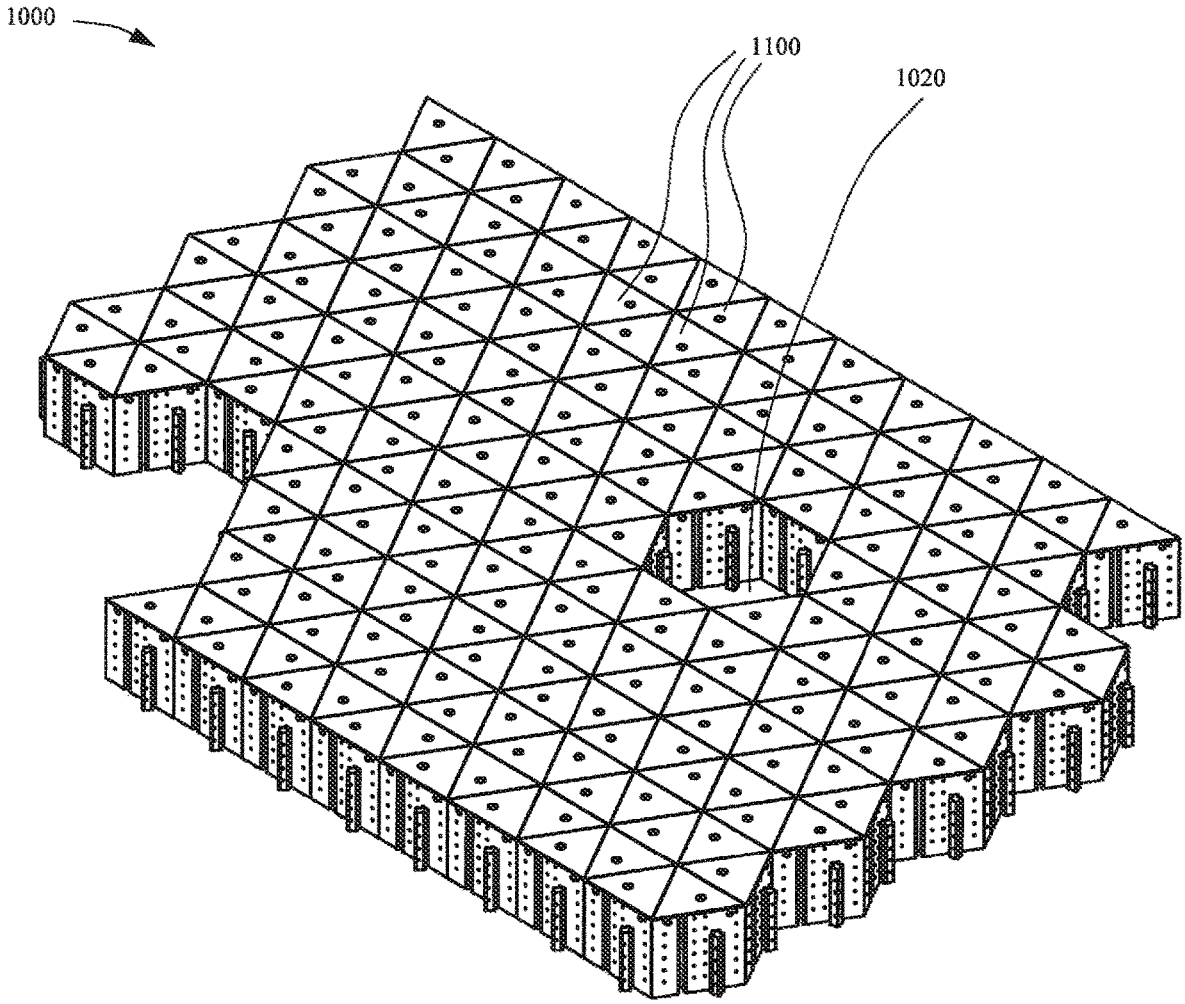
FIG. 7 is a perspective view of an island or a peninsula according to the invention.

Referring now to FIG. 7, the construction elements 1100 may be attached to each other so as to form an island or a peninsula 1000. Empty spaces or openings 1020 may be left to allow direct access to water below the structure. A ballast weight (not shown) may be attached to the bottom of some of the FBCs to help keep them vertical in case of strong side winds, surface waves, or to ease the assembly of the first FBCs. This avoids the FBCs falling on their side. Such ballast weight may help reduce the friction of the dovetail guides and grooves in helping keeping them parallel.

Figure 8A:
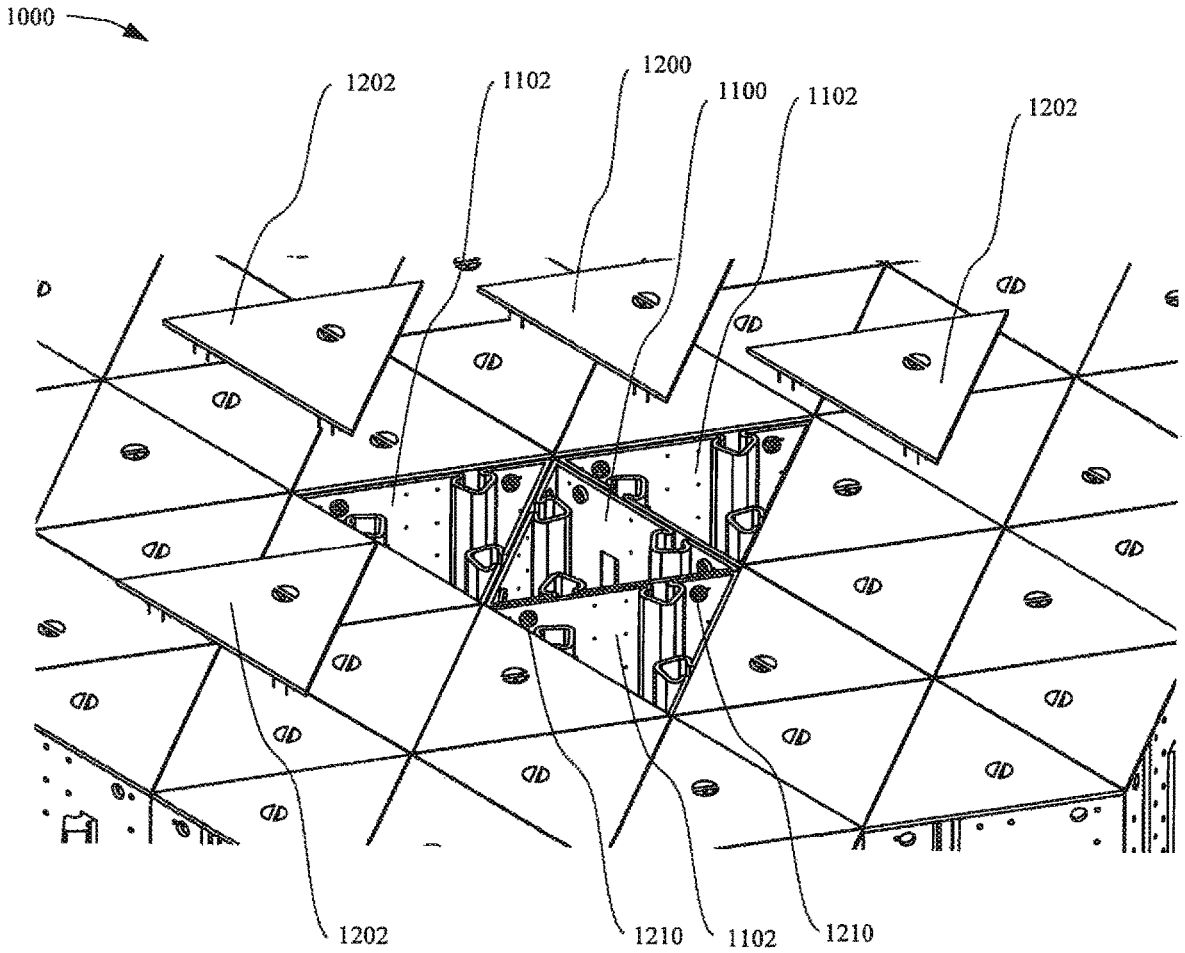
FIGS. 8A-B are perspective views of the assembly/disassembly of a building component in an island or a peninsula according to the invention.
Figure 8B:
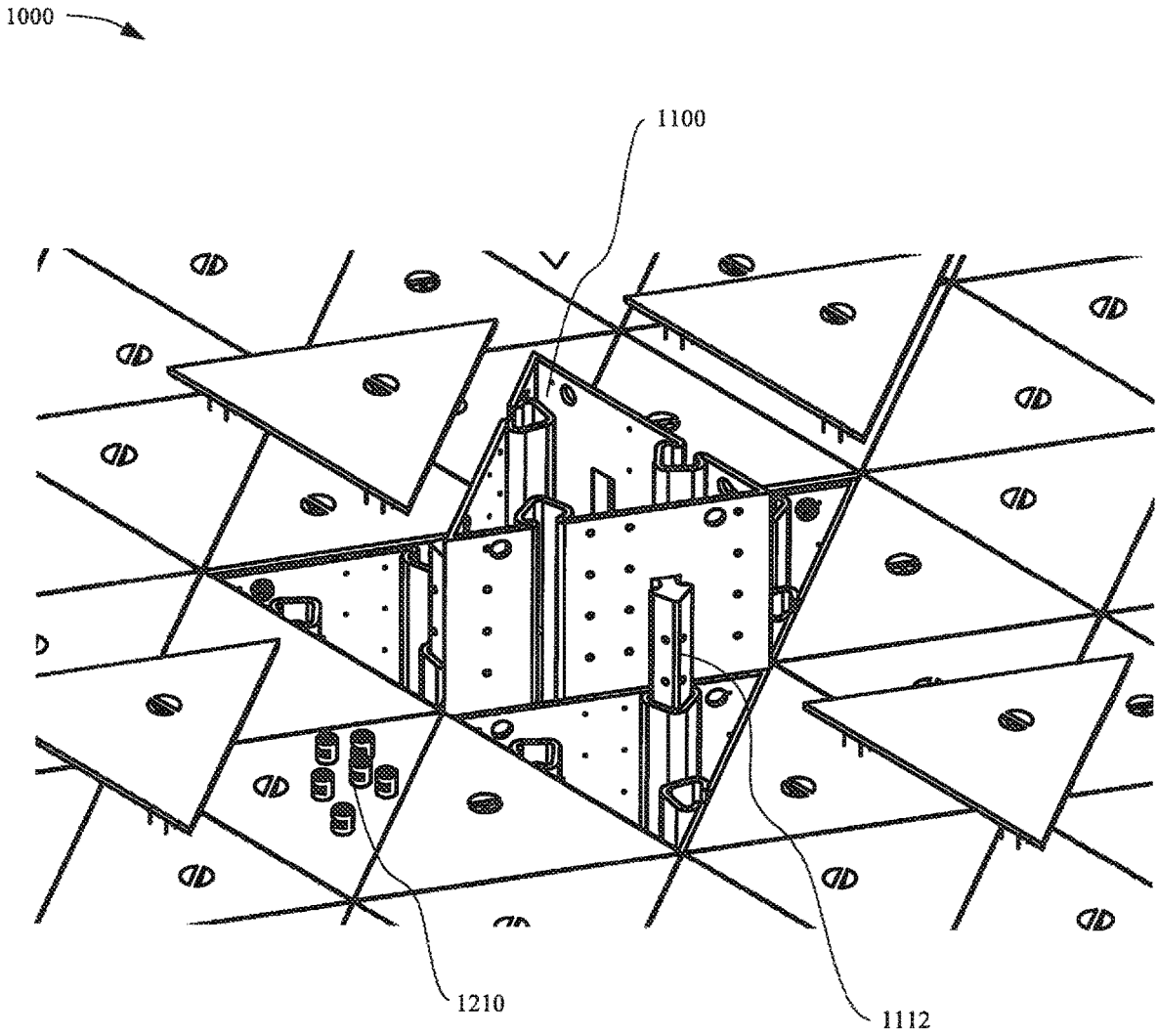

Referring now to FIGS. 8A-8B, any construction element 1100 may be added, removed or replaced by removing its cover 1200 and the covers 1202 of the neighboring construction elements 1102 to access the lockers 1210 and to free the dovetails 1112 from the adjacent dovetail grooves 1114 into which they were inserted, allowing free vertical movement. The bottom 1120 and the top cover 1200 of the construction element 1100 may present an appropriate shape so as to allow the removal of the construction element from an assembly by sliding it upwards or downwards. Downwards sliding of the construction element may be easily obtained by opening the valve or lid on its bottom cover 1120 to allow water into the construction element and thereby sinking it. The amount of free relative movement may be adjusted depending on the difference in the length of the dovetail 1112 and the length of the corresponding dovetail groove 1114 into which it slides, in such case no lockers 1210 are used to allow for free sliding. Thanks to this vertical assembly/disassembly possibility, the floating territory may be assembled with a shape similar to the shape of a boat and be displaced to its installation location using the fins and spoiler shapes protruding below the construction elements, and motors, propellers, and control surfaces attached below the construction elements, and then partially or fully disassembled and re-assembled into another shape that is more appropriate for an habitable territory at the installation site.

However, in an alternative embodiment, any construction element 1100 may be added, removed or replaced without the need of removing its cover 1200 and the covers 1202 of the neighboring construction elements to access the lockers 1210 and to free the dovetails 1112 from the adjacent dovetail grooves 1114 into which they were inserted, allowing free vertical movement. In this embodiment, the vertical movement limitation by the cover 1200 on the dovetails is not present. It may be desirable to maintain the possibility of easily replace any FBC at any position and any time, and of course make it unsinkable, so the top cover 1200 will have a very similar shape as the bottom 1120, thereby allowing free sliding of the dovetails in the grooves in which case the dovetail and dovetail grooves can have the same length as the entire height of the FBC. Nevertheless, both the bottom 1120 and the cover 1200 may be equipped with a valve or a lid to allow emptying or filling with water in order to manage its buoyancy. This allows the FBC to be of a simple shape, easier to produce industrially. Of course, in this case, the bottom cover can also have the same shape as the top cover 1200, and the dovetail the same length as the grooves, thereby creating a non-sliding, more rigid structure. In this forgoing case, set screws in one embodiment that fix the covers to the walls can be adapted to be operated (so as to disengage the bottom cover) from the inside of the FBC.

Figure 9A:
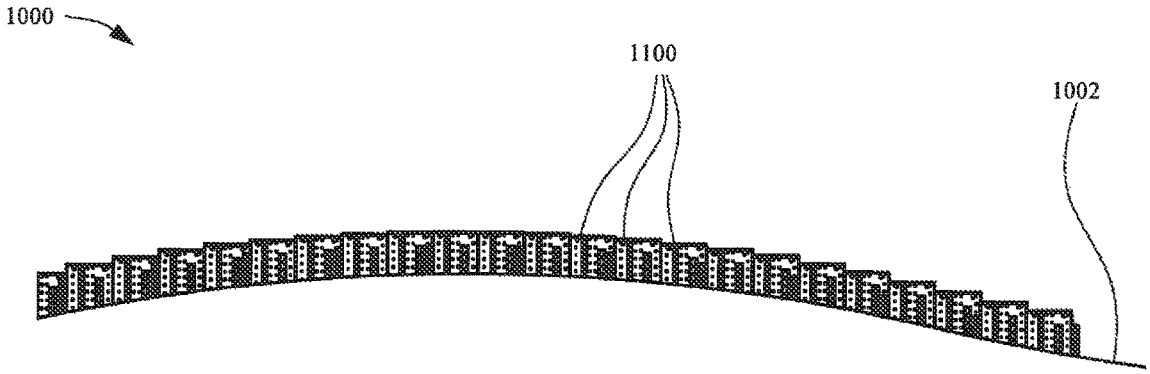
FIG. 9A is a side view of an island or a peninsula according to the invention.
Figure 9B:
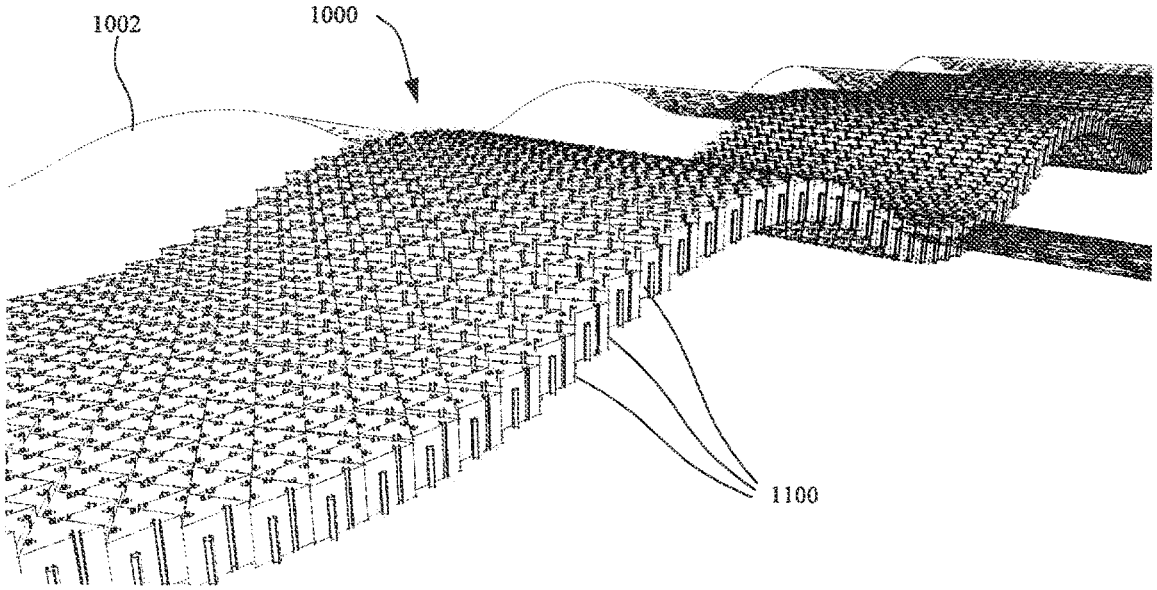
FIG. 9B is a general perspective view of an island or a peninsula according to the invention.

Referring now to FIG. 9A-9B, the relative freedom to move vertically from one construction (allowed by this difference in length mentioned immediately above) element 1100 to the next construction element allows the island or peninsula 1000 to accommodate the movement of the waves 1002.

It is another object of the present invention to provide appropriate attachment means to control the relative movements of the FBC. The attachment means may be purely passive attachment such as ropes, cables, shock absorbers and the like, or be the interlocking of the shapes of the construction elements themselves, or any combination of such means. The attachment means may be produced from the recycling of ocean waste found on the site of plastic waste collection. Active attachment means such as hydraulic pistons, electrically operated winches and similar devices, under the control of an automatic control system, may also be used to optimize the behaviour of the floating island or peninsula. Appropriate attachment means may be used to collect energy from the relative movement between the FBCs produced by the waves. For example, dynamos may be attached in recesses, which have wheels which are engaged with an adjacent surface on an adjacent element, the dynamos being electrically connected to batteries for storing the electric energy generated thereby. The engagement may be frictional or consist of a gear and rack. Optionally, the FBC may house one or more such batteries which are adapted to store energy collected in the proximity of the FBC.

It is a further object of the present invention to provide attachment means on the FBC for a superstructure to be built on top of the floating island, or for semi-immersed or fully immersed structures that may be floating under the water below the island.

It is still a further object of the present invention to configure the FBC so that they can be produced and assembled at the site of waste collection. In such case, the FBC may be made in an appropriate size and weight so that they can be manipulated, assembled and/or disassembled by humans without the need for heavy lifting equipment, and so that they can be filled after assembly to an appropriate level with sea water or with waste or with any other material to adjust their density, resulting in a floating height adapted to their function, and allowing the construction of a floating island on the location of the plastic waste collection and recycling. The resulting floating island may be used as a base for the construction and operation of further recycling equipment or for any other activities. It may also be used to create new territories, either freely moving on oceans, or attached to land or to an island in order to increase its surface or to recreate surface that may have been lost due to e.g. increasing sea level. Such floating islands or peninsula may be dedicated to specific uses such as agriculture, partially submerged agriculture, raising livestock, sun energy harvesting, waves energy harvesting, wind energy harvesting, living quarters, or any combination thereof. Floating islands or peninsula may be installed at the periphery of areas being eroded by the waves such as cliffs, coral reefs and the like, to absorb at least a part of the waves energy and reduce their impact.

In order to create the floating sub-assembly while floating on the water, the assembly sequence of main construction elements 100, which should be clear from the instant disclosure with reference to the drawings, may be started in any direction, in order to create a line of construction elements, by:

a. sliding a junction element 300 horizontally in the side recess 102 of a first main construction element 100;
b. attaching the junction element 300 to the first main construction element 100 by inserting the locking element 400 vertically through the holes 122, 320;
c. sliding the second main construction element 100 horizontally unto the second half of the junction element 300, which is protruding from the face of the first main construction element 100;
d. locking the second main construction element 100 unto the junction element 300 by inserting a second locking element 400 in the holes 121, 321; and
e. repeating the sequence until obtaining a line of main construction elements of the desired length.

After the first line of main construction elements 100 is assembled, the progressive addition of a second line of main construction elements 100 requires attachment both to the line in construction (line attachment) and to the previous line (row attachment), both attachments being orthogonal to each other. To allow the row attachment without interference from the line attachment, access to install the junction element 300 for the row attachment is provided by removing the secondary construction element 200, which is accessible from the top of the main construction element 100. After the installation of the junction element 300, the secondary construction element is placed on top, and secured with a locking element 400 inserted in the hole 123, completing the parallelepiped shape of the main construction element 100 and providing the same attachment possibilities providing the same attachment possibilities for the next line attachment (vertical insertion of locking elements to secure the junction). In this way a whole floating structure can be assembled from the top, without the need for operation from the sea level or from below sea level.

When using construction elements with vertical dovetail guide shapes, the assembly sequence of main construction elements 1100 may be executed as follows:

i. sliding the dovetail 1112 of a construction element 1100 in the dovetail groove 1114 of a first main construction element 1100;
ii. optionally sliding one or more lockers 1210 into the corresponding holes 1116 of the construction elements 1100 in order to obtain a rigid connection;
iii. optionally filing the main construction elements 1100 with water, with waste or with any appropriate material to adjust their overall density;
iv. closing the main construction elements 1100 with a cover 1200 so as to close the construction elements in a watertight manner, selecting the cover 1200 shape with an appropriate geometry so as to optionally limit the vertical movement freedom relative to their neighboring main construction elements 1100; and
v. repeating the sequence until obtaining a surface of main construction elements of the desired size and shape.

During the assembly or after the construction of a part of a floating island, the FBC may be filled to an appropriate level with sea water or with waste or with any other material to adjust their density and buoyancy, resulting in a floating height adapted to their function (platform, beach, port, wave barrier, etc). The FBC may be sealingly closed later, thereby making the assembly unsinkable, even in very severe weather. Nevertheless, each element can be reopened if necessary for repair, adjustment or reuse.

Adapting the payload capacity of a given FBC or group of FBCs may also be obtained by sealing of such FBC in a watertight manner, and then adding and attaching a vertical column of one or more FBCs on top of it. Such adaptation may be made at any point in time or any location of the island or peninsula, thanks to the vertical access to any individual FBC provided by the dovetail guide system.

Figure 10:
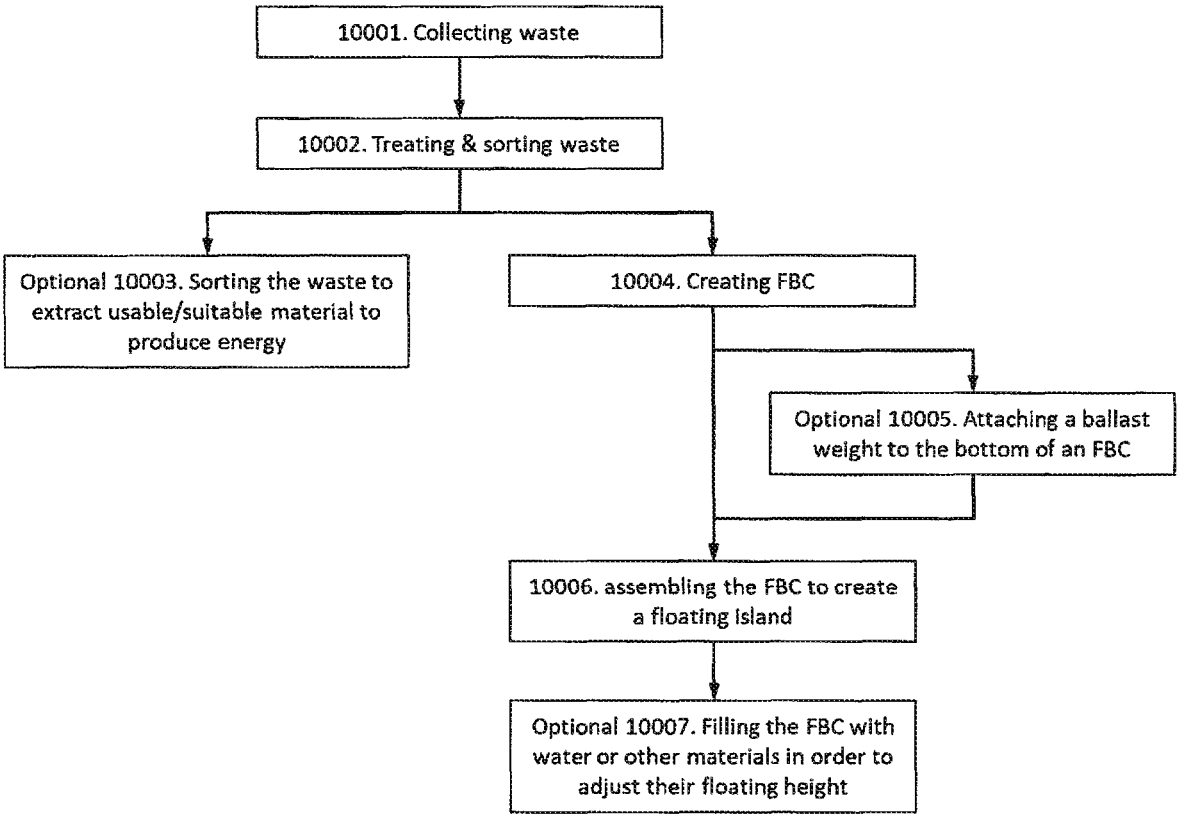
FIG. 10 is a flow chart of a method of the invention.

Referring to FIG. 10, a method of creating and adapting a FBC is provided. The method may be described as:

a. collecting waste, preferably plastic waste;
b. treating, sorting such waste to extract material usable/suitable to create FBCs;
c. optionally treating, sorting the waste to extract usable/suitable material to produce energy to drive the present process steps;
d. creating FBC out of the usable/suitable material through processes like injection moulding, thermoforming, or any other suitable process;
e. optionally attaching a ballast weight to the bottom of an FBC in order to stabilize the FBC in an upright position, once placed in the water;
f. assembling the FBC to create a floating island; and
g. optionally filling the FBC with water or other materials in order to adjust their floating height, and by way of consequence, the global shape of the island.

The first method step 10001 of collecting waste may be performed manually, using nets, or floating barriers. It also may be performed semi-automatically, using human-piloted machinery or equipment, or automatically with autonomous vehicles and machinery, crunching the waste into substantially similar sizes of particles, and relying on differentiating physical properties of the elements collected in order to sort them. A second method step 10002 of treating, sorting such waste to extract material usable/suitable to create FBC may involve cleaning, disinfection, crunching into smaller granulate and mixing with additive such as cement, resins, and the like. A third method step 10003 is optional and involves sorting the waste to extract usable/suitable material to produce energy to drive the present process steps. The sorting may involve human-piloted equipment, semi-automatic or automatic machinery, and rely on differentiating physical properties of the elements to be sorted. A fourth method step 10004 of creating FBC out of the usable/suitable material through processes like injection moulding, thermoforming, or any other suitable process can be accomplished by usual industrial equipment installed on ships, on barges, or on a first part of floating island. An optional fifth method step 10005 involving attaching a ballast weight to the bottom of an FBC in order to stabilize the FBC in an upright position once placed in the water, can be accomplished by divers once the FBC is on the water, or prior to installing the FBC in the water, and use any attachment means, including optionally recycled attachment means found in the waste or transformed out of previously sorted waste material. A sixth method step 10006 of assembling the FBC to create a floating island follows the substeps mentioned above of the instant specification, when referring to FIG. 7. A seventh method step 10007 involves optionally filling the FBC with water or other materials in order to adjust their floating height, and by way of consequence, the global shape of the island. This can be accomplished by opening valves or lids (not shown) placed at the bottom of the FBC, which then allows water to enter until the desired buoyancy is obtained.

Figure 11:
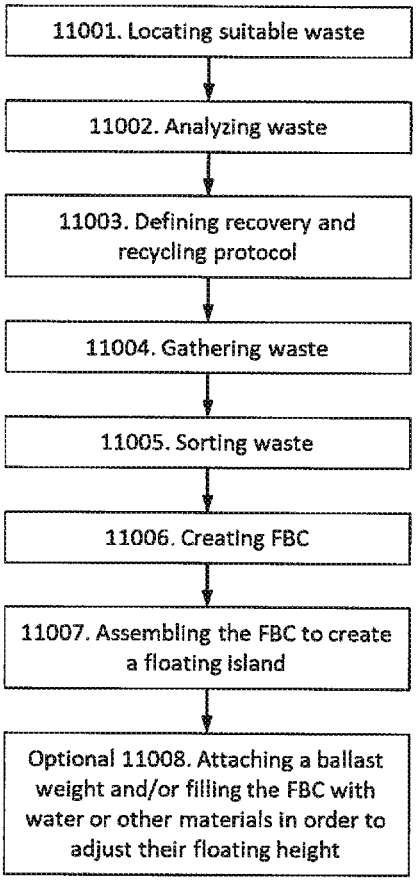
FIG. 11 is a flow chart of an alternate method of the invention.

Referring now to FIG. 11, an alternate method of converting waste into structures, for example, floating structures or territories, is provided. The method includes several steps. In a first step 11001, suitable waste deposits are located. In a second step 11002, the nature and distribution of the waste deposits are analyzed. In a third step 11003, based on the results of the analysis, a recovery and recycling protocol applying dedicated equipment suitable to a construction objective is developed. In a fourth step 11004, the waste is harvested using waste gathering means selected according to the protocol. In a fifth step 11005, the waste is sorted and gathered into types of waste suitable for selected processes applied by the dedicated equipment. In a sixth step 11006, the selected waste is processed according to the selected processes to create building elements for use in the construction objective. In a seventh step 11007, the FBC are assembled together to create a floating structure. In an eighth step 11008, the FBCs are optionally oriented by attaching a weight to the lower end thereof and/or by filling with water or other materials in order to adjust their floating height, and therefore, the overall shape of the island. As a result, a floating territory able to follow the upward and downward movement of the waves is provided.

In more detail, the method in the first step 11001, suitable waste deposits are located using aerial photography, autonomous or remote-controlled drones, or GPS-tagged photos reported by eyewitnesses. In the second step 11002, the nature and distribution of the waste deposits are analyzed by considering the color distribution of the waste or, alternatively, a common distribution of constituents is assumed. In the third step 11003, based on the results of the analysis, a recovery and recycling protocol applying dedicated equipment suitable to a construction objective is developed. If the waste is primarily plastic waste, then plastic filtering and gathering equipment is identified. In the fourth step 11004, the waste recovery machinery is deployed to the location of the waste and operated according to the protocol. In the fifth step 11005, the waste is sorted and gathered into types of waste suitable for selected processes applied by the dedicated equipment. In the sixth step 11006, the selected waste is processed according to the selected processes to create building elements for use in the construction objective. This would involve typically injection moulding of the elements, the moulding equipment typically being located on barges floating near the collection site, on ships, or on a first part of floating island. In the seventh step 11007, the elements are assembled together to create a structure. In an eighth step 11008, the FBCs are oriented by attaching a weight to the lower end thereof and/or optionally filed with water or other materials in order to adjust their floating height. As a result, a floating territory adapted to follow the upward and downward movement of the waves is provided.

The invention can be summarized as follows:

1. A floating territory made of at least two floatable building components, at least two of the at least two components having a first regular polygonal base end and a second regular polygonal cover end and walls extending essentially in a common direction from the base end to the cover end to enclose a watertight compartment therein, the walls including attachment elements comprising dovetails and dovetail grooves for sliding attachment to adjacent complementary attachment elements of an adjacent component, the attachment elements comprising dovetail grooves and dovetails respectively, said attachment elements, when interconnected, allowing said floatable building components to slide vertically relative to each other, thereby allowing the floating territory to follow upward and downward movements of the waves.

2. The floating territory of feature set 1, wherein the regular polygonal base and/or cover is selected from one of a list of forms consisting of a triangle, a square, a pentagon, and a hexagon.

3. The floating territory of feature set 1 or 2, wherein at least one cover extends over the dovetail grooves so as to provide a substantially seamless surface.

4. The floating territory of feature set 3, wherein the length of the dovetail grooves is longer than the length of the dovetails, thereby providing a defined amount of play allowing relative sliding movement between the building components.

5. The floating territory according to feature set 1, wherein at least one cover end is removable and extends over a dovetail groove so as to limit movement of a dovetail therein.

6. The floating territory according to feature set 1, wherein some floatable building components are covered each individually with a cover limiting their freedom to move vertically relative to their neighboring floatable building components.

7. The floating territory according to feature set 1, wherein some floatable building components are locked to their neighboring floatable building components to provide a substantially rigid surface.

8. The floating territory of feature set 1, wherein the external surfaces of the floating building components includes bosses or raised portions to minimize sticking.

9. The floating territory according to feature set 1, wherein the floatable building components are of differing heights according to their intended payload, so that the resulting territory when carrying its payload presents a substantially flat surface.

10. The floating territory according to feature set 1, wherein the floatable building components are filled to different levels with water or with any other suitable material according to their intended payload, so that the resulting territory when carrying its payload presents a substantially flat surface.

11. The floating territory according to feature set 1, wherein the floatable building components are layered on top of each other in a plurality of layers according to their intended payload, so that the resulting territory when carrying its payload presents a substantially flat surface.

12. The floating territory according to feature set 1, wherein one or more of the floatable building components have a ballast weight attached, so that the floatable building component is stabilized in an upright position, once placed in the water.

13. A method of converting floating ocean waste into structures, in particular, floating structures, includes the steps of:

(a) locating suitable floating waste deposits;
(b) analyzing the nature and distribution of the waste deposits;
(c) based on the results of the analysis, developing a recovery and recycling protocol applying dedicated equipment suitable to a construction objective;
(d) harvesting the waste using waste gathering means selected according to the protocol;
(e) sorting the waste gathered into types of waste suitable for selected processes applied by the dedicated equipment;
(f) processing the selected waste according to the selected processes to create building elements for use in the construction objective;
(g) attaching the building elements together to create a floating structure; (g) optionally attaching a ballast weight to the bottom of the floating structure in order to stabilize the floating structure in an upright position, once positioned in the water and/or optionally filling the FBC with water or other materials in order to adjust their floating height, and therefore the overall shape of the island.

14. The method of feature set 13, wherein the harvesting is performed using floating vessels and floating barriers attached thereto.

15. The method of feature set 13, wherein the sorted waste is processed using equipment suitable to process such waste into building components on site, where the waste is found.

16. The method of feature set 13, wherein some sorted waste is converted into energy to power the dedicated equipment.

17. The method of feature set 13, wherein the construction objective is to construct floating elements adjacent the waste.

18. The method of feature set 17, wherein solar panels which help power the dedicated equipment are mounted on the floating elements so constructed.

19. A building element made according to the method of feature set 13, wherein the building elements include poka-yoke features.

20. A building element made according to the method of feature set 13, wherein the building elements include gliding and/or sliding features to allow relative displacement of the building elements in directions where there is significant shear.

21. A building element made according to the method of feature set 13, wherein the building elements incorporate functional surfaces and forms to suit specific functional needs such as use for sea access ramp or stairs, waves energy absorbers, and plant culture containers.

22. A building element made according to the method of feature set 13, wherein the building elements include interlocking features.

23. A set of floatable building elements made according to the method of feature set 13.

24. An articulated assembly made of floatable building elements made according to the method of feature set 13.

25. A floating island made of floatable building elements made according to the method of feature set 13.

26. A peninsula made of floatable building elements made according to the method of feature set 13.

27. The method of converting floating ocean waste into structures, in particular, floating structures, includes the steps of:

a) collecting waste, preferably plastic waste;
b) treating, sorting such waste to extract material usable/suitable to create FBCs;
c) optionally treating, sorting the waste to extract usable/suitable material to produce energy to drive the present process steps;
d) creating FBC out of the usable/suitable material through processes like injection moulding, thermoforming, or any other suitable process;
e) optionally attaching a ballast weight to the bottom of an FBC in order to stabilize the FBC in an upright position, once placed in the water;
f) assembling the FBC to create a floating island; and
g) optionally filling the FBC with water or other materials in order to adjust their floating height, and by way of consequence, the global shape of the island.

In an advantage, by using the invention it is possible to build a territory with floatable building components which are all identical (See FIG. 6A).

In another advantage, by using the invention it is possible to build a territory without any additional attachment between the floatable building components (in other words, features 1116/1210 are clearly optional).

It should be appreciated that the particular implementations shown and herein described are representative of the invention and its best mode and are not intended to limit the scope of the present invention in any way. For example, as the floating island may be used for any kind of human activities, attachment means for the island described herein enabling it to remain connected to the land so as to form a peninsula, or to connect one or more parts of land so as to form a floating bridge or road are also to be considered part of this invention.

As will be appreciated by skilled artisans, the present invention may be embodied as a system, a device, or a method.

The present invention is described herein with reference to block diagrams, devices, components, and modules, according to various aspects of the invention. Moreover, the system contemplates the use, sale and/or distribution of any goods, services or information having similar functionality described herein.

The specification and figures should be considered in an illustrative manner, rather than a restrictive one and all modifications described herein are intended to be included within the scope of the invention claimed. Accordingly, the scope of the invention should be determined by the appended claims (as they currently exist or as later amended or added, and their legal equivalents) rather than by merely the examples described above. Steps recited in any method or process claims, unless otherwise expressly stated, may be executed in any order and are not limited to the specific order presented in any claim. Further, the elements and/or components recited in apparatus claims may be assembled or otherwise functionally configured in a variety of permutations to produce substantially the same result as the present invention. Consequently, the invention should not be interpreted as being limited to the specific configuration recited in the claims.

Benefits, other advantages and solutions mentioned herein are not to be construed as critical, required or essential features or components of any or all the claims.

As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements such as those described in the instant specification. Unless otherwise explicitly stated, the use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or adapted by the skilled artisan to other designs without departing from the general principles of the invention.

The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Additional features and functionality of the invention are described in the claims appended hereto and/or in the abstract. Such claims and/or abstract are hereby incorporated in their entirety by reference thereto in this specification and should be considered as part of the application as filed.

Multiple variations and modifications are possible in the embodiments of the invention described here. Although certain illustrative embodiments of the invention have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims which ultimately issue in this application.

What is claimed is:

1. A floating territory made of at least two floatable building components, at least two of the at least two components having a first regular polygonal base end and a second regular polygonal cover end and walls extending essentially in a common direction from the base end to the cover end to enclose a watertight compartment therein, the walls including integral attachment elements comprising dovetails and dovetail grooves for sliding attachment to adjacent complementary attachment elements of an adjacent component, the dovetail grooves extending along the walls from the base end to the cover end, wherein said attachment elements of the building component, when interconnected to another attachment element of another building component, (a) allowing attachment between building components without intermediate components and (b) allowing said floatable building components to slide vertically relative to each other so that the floating territory is able to follow upward and downward movements of the waves.

2. The floating territory of claim 1, wherein the regular polygonal base and/or cover is selected from one of a list of forms consisting of a triangle, a square, a pentagon, and a hexagon.

3. The floating territory of claim 1, wherein at least one cover extends over the dovetail grooves so as to provide a substantially seamless surface.

4. The floating territory according to claim 1, wherein at least one cover end is removable and extends over a dovetail groove so as to limit movement of a dovetail therein.

5. A floating territory made of at least two floatable building components, at least two of the at least two components having a first regular polygonal base end and a second regular polygonal cover end and walls extending essentially in a common direction from the base end to the cover end to enclose a watertight compartment therein, the walls including integral attachment elements comprising dovetails and dovetail grooves for sliding attachment to adjacent complementary attachment elements of an adjacent component, the dovetail grooves extending along the walls, wherein said attachment elements of the building component, when interconnected to another attachment element of another building component, (a) allowing attachment between building components without intermediate components and (b) allowing said floatable building components to slide vertically relative to each other so that the floating territory is able to follow upward and downward movements of the waves, wherein some floatable building components are locked without significant vertical play to their neighboring floatable building components to provide a substantially rigid surface.

6. A floating territory made of at least two floatable building components, at least two of the at least two components having a first regular polygonal base end and a second regular polygonal cover end and walls extending essentially in a common direction from the base end to the cover end to enclose a watertight compartment therein, the walls including integral attachment elements comprising dovetails and dovetail grooves for sliding attachment to adjacent complementary attachment elements of an adjacent component, the dovetail grooves extending along the walls, wherein said attachment elements of the building component, when interconnected to another attachment element of another building component, (a) allowing attachment between building components without intermediate components and (b) allowing said floatable building components to slide vertically relative to each other so that the floating territory is able to follow upward and downward movements of the waves, wherein the external surfaces of the floating building components includes bosses or raised portions to minimize sticking between adjacent building components.

7. A floating territory made of at least two floatable building components, at least two of the at least two components having a first regular polygonal base end and a second regular polygonal cover end and walls extending essentially in a common direction from the base end to the cover end to enclose a watertight compartment therein, the walls including integral attachment elements comprising dovetails and dovetail grooves for sliding attachment to adjacent complementary attachment elements of an adjacent component, the dovetail grooves extending along the walls, wherein said attachment elements of the building component, when interconnected to another attachment element of another building component, (a) allowing attachment between building components without intermediate components and (b) allowing said floatable building components to slide vertically relative to each other so that the floating territory is able to follow upward and downward movements of the waves, wherein the floatable building components are of differing heights according to their intended payload, so that the resulting territory when carrying its intended payload presents a substantially flat surface.

8. The floating territory according to claim 1, wherein the floatable building components are filled to different levels with water or with any material according to their intended payload, so that the resulting territory when carrying its payload presents a substantially flat surface.

9. A floating territory made of at least two floatable building components, at least two of the at least two components having a first regular polygonal base end and a second regular polygonal cover end and walls extending essentially in a common direction from the base end to the cover end to enclose a watertight compartment therein, the walls including integral attachment elements comprising dovetails and dovetail grooves for sliding attachment to adjacent complementary attachment elements of an adjacent component, the dovetail grooves extending along the walls, wherein said attachment elements of the building component, when interconnected to another attachment element of another building component, (a) allowing attachment between building components without intermediate components and (b) allowing said floatable building components to slide vertically relative to each other so that the floating territory is able to follow upward and downward movements of the waves, wherein the floatable building components are layered on top of each other in a plurality of layers according to their intended payload, so that the resulting territory when carrying its payload presents a substantially flat surface.

10. The floating territory according to claim 1, wherein one or more of the floatable building components have a ballast weight attached, so that the floatable building component is stabilized in an upright position, once placed in the water.

11. A method of converting floating ocean waste into structures, in particular, floating structures, includes the steps of:

(a) locating suitable floating waste deposits;
(b) analyzing the nature and distribution of the waste deposits;
(c) based on the results of the analysis, developing a recovery and recycling protocol applying dedicated equipment suitable to a construction objective;
(d) harvesting the waste using waste gathering means selected according to the protocol;
(e) sorting the waste gathered into types of waste suitable for selected processes applied by the dedicated equipment;
(f) processing the selected waste according to the selected processes to create building elements for use in the construction objective;
(g) attaching the building elements together configured according to claim 1 to create a floating structure; and
(h) optionally attaching a ballast weight to the bottom of the floating structure in order to stabilize the floating structure in an upright position, once positioned in the water and/or optionally filling the floatable building components with water or other materials in order to adjust their floating height, and therefore the overall shape of the island.

12. The method of claim 11, wherein the harvesting is performed using floating vessels and floating barriers attached thereto.

13. The method of claim 11, wherein the sorted waste is processed using equipment suitable to process such waste into building components on site, where the waste is found.

14. The method of claim 11, wherein some sorted waste is converted into energy to power the dedicated equipment.

15. A building element made according to the method of claim 11, wherein the building elements include poka-yoke features.

16. A building element made according to the method of claim 11, wherein the building elements incorporate functional surfaces and forms to suit for a sea access ramp or stairs and/or waves energy absorbers and/or plant culture containers.

17. A set of floatable building elements made according to the method of claim 11.

18. An assembly made of floatable building elements made according to the method of claim 11.

19. The method of converting floating ocean waste into structures, in particular, floating structures, includes the steps of:

a) collecting waste, preferably plastic waste;
b) treating, sorting such waste to extract material usable/suitable to create floating building component;
c) optionally treating, sorting the waste to extract usable/suitable material to produce energy to drive the present process steps;
d) creating floatable building component out of the usable/suitable material through injection or moulding or thermoforming;
e) optionally attaching a ballast weight to the bottom of a floatable building component in order to stabilize the floatable building component in an upright position, once placed in the water;
f) assembling the floatable building component to create a floating island; and
g) optionally filling the floatable building component with water or other materials in order to adjust their floating height, and by way of consequence, the global shape of the island.

20. A floating island made of floatable building elements made according to the method of claim 11.

21. A peninsula made of floatable building elements made according to the method of claim 11.

* * * * *